United States Patent [19]

Dorfman, Jan L.

[11] Patent Number: 4,867,348

[45] **Date of Patent: * Sep. 19, 1989**

[54] DISPOSABLE PACKAGE FOR USE IN MARKETING FLUIDS

[75] Inventor: Dorfman, Jan L., Littleton, Colo.

[73] Assignee: Adolph Coors Company, Golden, Colo.

[ * ] Notice: The portion of the term of this patent subsequent to Apr. 26, 2005 has been disclaimed.

[21] Appl. No.: 34,859

[22] Filed: Apr. 6, 1987

Related U.S. Application Data

[63] Continuation-in-part of Ser. No. 735,160, May 17, 1985, abandoned.

[51] Int. Cl.[4] ..... B67D 5/64; B65D 83/00

[52] U.S. Cl. ..... 222/173; 222/386.5; 222/394; 222/396; 222/397; 222/183; 222/506; 220/69

[58] Field of Search ..... 222/183, 505, 509, 549, 222/559, 564, 386.5, 501, 394, 399, 396, 397, 506, 522, 547, 173; 220/5 R, 69, DIG. 1, 71, 73; 251/126, 101

[56] References Cited

U.S. PATENT DOCUMENTS

| | | | |
|---|---|---|---|
| 675,651 | 6/1901 | DeLacy | 220/69 |
| 2,185,267 | 1/1940 | Rice | 251/126 X |
| 2,762,534 | 9/1956 | Kish | 222/386.5 |
| 3,080,093 | 5/1963 | Wilson | 222/386.5 X |
| 3,096,000 | 7/1963 | Staley | 222/386.5 X |
| 3,128,019 | 4/1964 | Mills | 222/396 |
| 3,244,326 | 4/1966 | Bull, Jr. | 222/61 |
| 3,718,236 | 2/1973 | Reyner et al. | 222/386.5 X |
| 3,952,904 | 4/1976 | Verlinden | 220/5 R |
| 4,032,047 | 6/1977 | Wilson | 222/183 |
| 4,438,856 | 3/1984 | Chang | 220/69 X |
| 4,482,067 | 11/1984 | Saito et al. | 220/69 X |
| 4,531,556 | 7/1985 | Nitchman et al. | 222/183 X |
| 4,739,901 | 4/1988 | Dorfman et al. | 222/564 X |

*Primary Examiner*—Kevin P. Shaver
*Assistant Examiner*—Stephen B. Parker
*Attorney, Agent, or Firm*—Klaas & Law

[57] ABSTRACT

A disposable package comprising a plastic container secured to plastic protective and support members so that the container may be supported in a vertical position during shipment and commercial storage and in a horizontal position, such as refrigerator shelf, for consumer use. In the preferred embodiment, the container contains a desired quantity of beer equal to a conventional case thereof. The container is provided with plastic dispensing apparatus having flow permitting apparatus movable between at least two positions so that in the first position there is no passageway between the fluid inside the container and the outside of the container and in a second position wherein the fluid in the container may be readily dispensed in separate portions over a period of time without degradation of the quality of the remaining portions of the fluid in the container. A self-generating pressure applying pouch is located within the container so as to maintain the pressure therein within a desired range of pressures so as to maintain the quality of the fluid and ensure that substantially all of the fluid is dispensed from the container. Flow control apparatus is also provided to control the rate at which fluid is dispensed from the container.

12 Claims, 11 Drawing Sheets

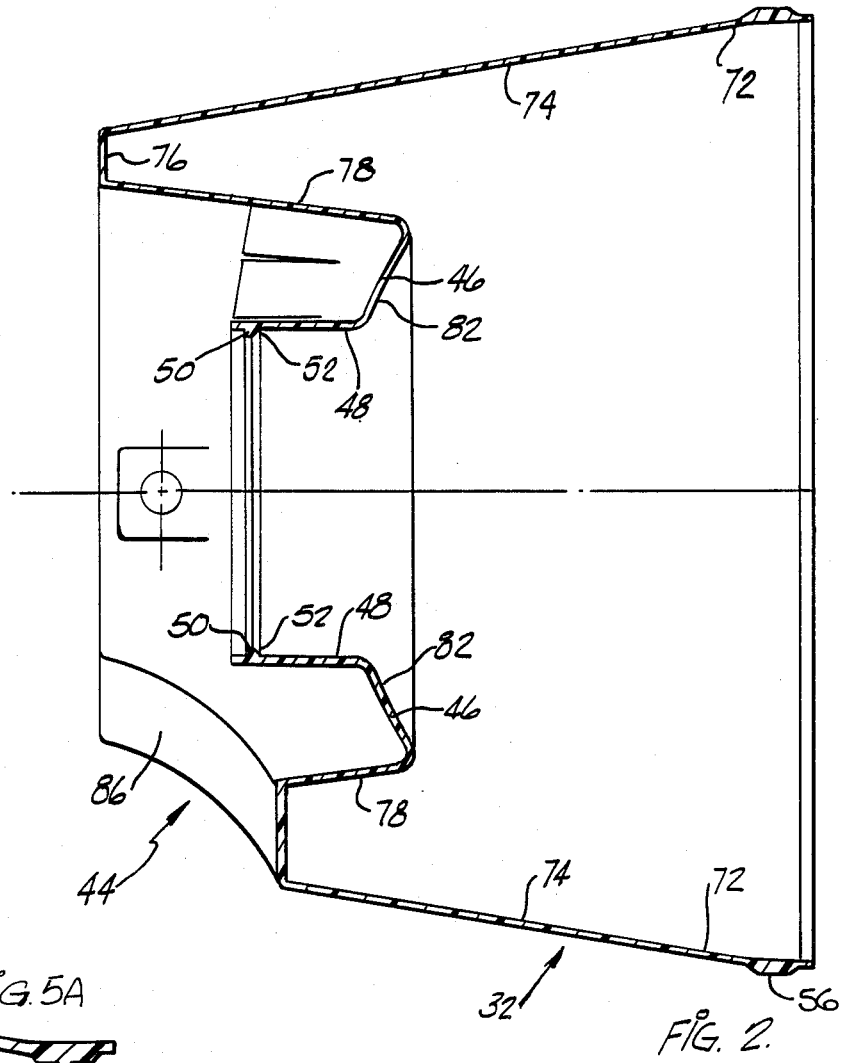
FIG. 2.
FIG. 5A
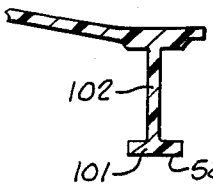
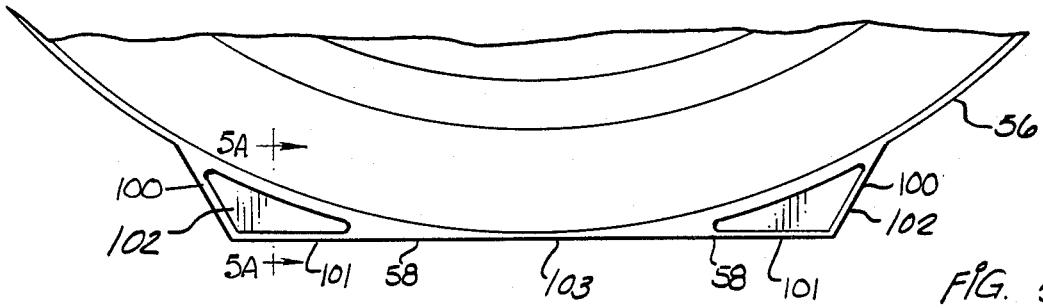
FIG. 5.

DISPOSABLE PACKAGE FOR USE IN MARKETING FLUIDS

This application is a continuation-in-part of U. S. patent application Ser. No. 735,160 filed May 17, 1985 now abandoned.

FIELD OF THE INVENTION

This invention relates generally to a package for use in the marketing of various types of fluids wherein the fluid is contained in a container forming part of the package and the fluid is dispensed from the container without exposing the fluid in the container to the atmosphere and is more particularly directed to containers of this nature wherein the fluid contained in the container is a carbonated beverage, such as beer, soft drinks and sparkling wines and the package is disposable.

BACKGROUND OF THE INVENTION

In the marketing of fluids, particularly in the marketing of consumable beverages, it has always been desirable to package the beverages so that they may be readily distributed to the market place and at the same time preserve their natural qualities, such as flavor and carbonation levels, until opened to be consumed. While this type of marketing has been successful in the marketing of beverages in the conventional twelve fluid ounce containers, difficulties have been encountered in maintaining the product qualities of beverages packaged in larger containers once they have been initially opened. Recently, soft drink manufacturers have been marketing beverages in containers having fluid capacities of two or three liters. However, in some cases in order to preserve carbonation after the container has been opened, it is necessary to provide excess carbonation at the time the product is packaged. The equivalent internal pressures generated in the container with these carbonation levels can reach 55 psig at room temperature and 110 psig at 110° F. While some success has been obtained, even the use of excess carbonation levels does not prevent product quality degradation if the product is not consumed within a relatively short time after initial opening. In addition, the decay in product quality becomes more apparent as the container approaches empty. The characteristics associated with beer would not permit beer to be marketed under such packaging techniques.

Some attempts have been made in the past years to market beverages, and in particular beer, in containers having capacities of about two and one-quarter gallons which capacity is equivalent to one case of twenty-four twelve ounce cans. These attempts generally involved the use of strong, expensive metallic containers and means for pressurizing the container to dispense the fluid therefrom. In view of the expenses involved, these containers had to be returned to the place of purchase and/or manufacture. Also, these containers were bulky and required excessive space for storage in a conventional home refrigerator. For the foregoing and other reasons, this type of marketing of beer was not successful. Therefore, it has long been desired to be able to market that quantity of beverage, two and one-fourth gallons, in a safe, non-toxic, low pressure container which requires the use of no external additional equipment, maintains the quality of the beverage over the entire dispensing life and is readily disposable.

For many years, one of the more acceptable ways to market beverages, such as draught beer, has been in kegs. Since the shape of a keg of beer is so well recognized, it would be desirable to market a disposable package for holding a case of beer in a container having the form of a keg. However, this presents problems since it is desirable that the disposable package of beer be capable of storage in a unit, such as a household refrigerator, so that it will be desirable to have the keg in a horizontal rather than the conventional upright position. This presents a problem since a keg in a horizontal position has a tendency to roll. Also, since a dispensing means is necessary to get the beer out of the container, special packaging is required to maintain the disposable package in a relatively fixed position so that the dispensing means is readily available and in a position to be used. In addition to the foregoing, the entire package must be as light as possible and provided with suitable means to facilitate transportation and placement at desired locations.

SUMMARY OF THE INVENTION

This invention provides a disposable package for marketing fluids in container means, preferably a plastic bottle designed to be capable of withstanding the internal pressures necessary to ensure the dispensation of the fluid from the container means, having dispensing means so that the fluid may be fully or partially dispensed from the container means without exposing the fluid in the container means to any deleterious conditions as those discussed above in association with conventional packaging techniques. A self-generating pressure applying means is located within the container means so as to maintain the pressure in the container means within a desired range of pressures throughout the shelf life and the dispensing of the fluid until the fluid is completely dispensed from the container means and to ensure that substantially all of the fluid is dispensed from the container means. The disposable package includes means for supporting the container means at a relatively fixed location and in a position so that the dispensing means associated therewith is readily accessible so that fluid may be dispensed therefrom. While the fluid may be dispensed from the container means with the package in any position, the preferred embodiment of the invention is provided with means so that the container means may be positioned on a horizontal surface, such as a table top or refrigerator shelf, while the fluid is being dispensed therefrom. In the preferred embodiment, the fluid is a liquid carbonated beverage and in particular it is beer.

In the preferred embodiment of the invention, the disposable package comprises a hollow integrally molded plastic container means having the desired capacity and having a hemispherical bottom portion, an annular central portion and a hemispherical top portion with an opening of a desired size in the top portion. Preferably, the dispensing means for the container means comprises an assembly of a plurality of integrally molded plastic parts and is secured in the opening in the top portion. The disposable package includes support, protective and decorative means which are secured to the container and are comprised of two separate integrally molded plastic members each of which is secured to the container means by suitable means. One of the members surrounds the top portion of the container means and means are provided on the top portion of the container means and the one member so as to prevent relative linear movement between the top portion of the container means and the one member. The other member surrounds the bottom portion and may be secured thereto by suitable means such as an adhesive. The one and the other members are each provided with means forming aligned planar surfaces so that the container means may be supported in a relative fixed position at any desired location lying generally in one plane, such as a table top or refrigerator shelf. The other member is also provided with another generally planar surface for supporting the disposable package on a plane perpendicular to the one plane. A handle is secured to the top portion of the one member to facilitate the carrying of the disposable package. The one and the other members are shaped so that when the disposable package is being supported solely by the another generally planar surface on the other member, one disposable package may be stacked on another disposable package with a portion of the one member nested in a portion of the other member for shipping and storage.

In the presently preferred embodiment of the invention, the self-generating pressure applying means comprises an expandable pouch means comprising two relatively flat sheets of a gas and liquid impermeable material in superposed relationship and having a hexagonal shape having a length and a width and with the edge portions thereof joined by permanent sealing means. The expandable pouch means is divided into a first compartment and a plurality of other compartments by a plurality of rupturable seam means. The first compartment contains two components of a gas generating means (not shown) which are activated as the expandable pouch means is inserted into the container. Each of the other compartments contains a quantity of one of the two components. As the gas is generated, the first compartment expands and as fluid is dispensed, the first compartment expands until it ruptures the next adjacent rupturable seam means. This process continues until all of the rupturable seam means have been ruptured and substantially all of the fluid has been dispensed from the container means. An expandable pouch of this nature is described in U.S. patent application Ser. No. 034,900 filed April 6, 1987, now abandoned by Jan L. Dorfman and Larry M. Dugan, A Self-Generating Pressure Applying Means For A Disposable Container, the disclosure in which is incorporated herein by reference.

In the preferred embodiment of the invention, the dispensing means includes a nozzle through which the fluid is dispensed; a passageway leading to the nozzle; means for opening and closing the passageway leading to the nozzle; a flow modulator for locking the dispensing means in an inoperative position during shipment, for placing the dispensing means in condition so that fluid may be dispensed from the container and for limiting the movement of the means for opening the passageway leading to the nozzle; a flow restrictor for reducing the pressure on the fluid as it flows therethrough; and means for ensuring that there is no passageway between the fluid in the container and the means for opening and closing the passageway leading to the nozzle until it is desired to use the dispensing means for the first time to dispense fluid from the container. Since the means for opening and closing the passageway leading to the nozzle is maintained and locked in a closed position during shipment and commercial storage, there is in effect a double seal until it is desired to use the dispensing means for the first time to dispense fluid from the container. Means are provided to maintain the pressures within the container within a desired range of pressures throughout the shelf life and dispensing cycle until the fluid is completely dispensed from the container and to ensure that substantially all of the fluid is dispensed from the container. The dispensing means are assembled using a plurality of parts which are integrally molded using a plastic material in view of economic considerations and the well established use of plastic in articles used in contact with food or beverages. The preferred dispensing means for use with a disposable container of this invention is described in U.S. patent application Ser. No. 034,899, filing date April 6, 1987, now U.S. Pat. No. 4,739,901, issued April 26, 1988 by Jan L. Dorfman and William C. Christine for Apparatus For Use In Dispensing Fluid From A Container, the disclosure in which is incorporated by reference and which includes puncture means which can be actuated to let the gas pressure escape from the expandable pouch means and the container means so that the disposable package may be safely placed in the trash.

BRIEF DESCRIPTION OF THE DRAWINGS

Illustrative embodiments of the invention, including the presently preferred embodiment, are shown in the accompanying drawings in which:

FIG. 2 is a view in section of one of the protective and support members;

FIG. 5 is an end view of a portion of FIG. 2;

FIG. 5A is a cross-sectional view taken on the line 5A—5A of FIG. 5;

DETAILED DESCRIPTION OF THE INVENTION

Figure 1:
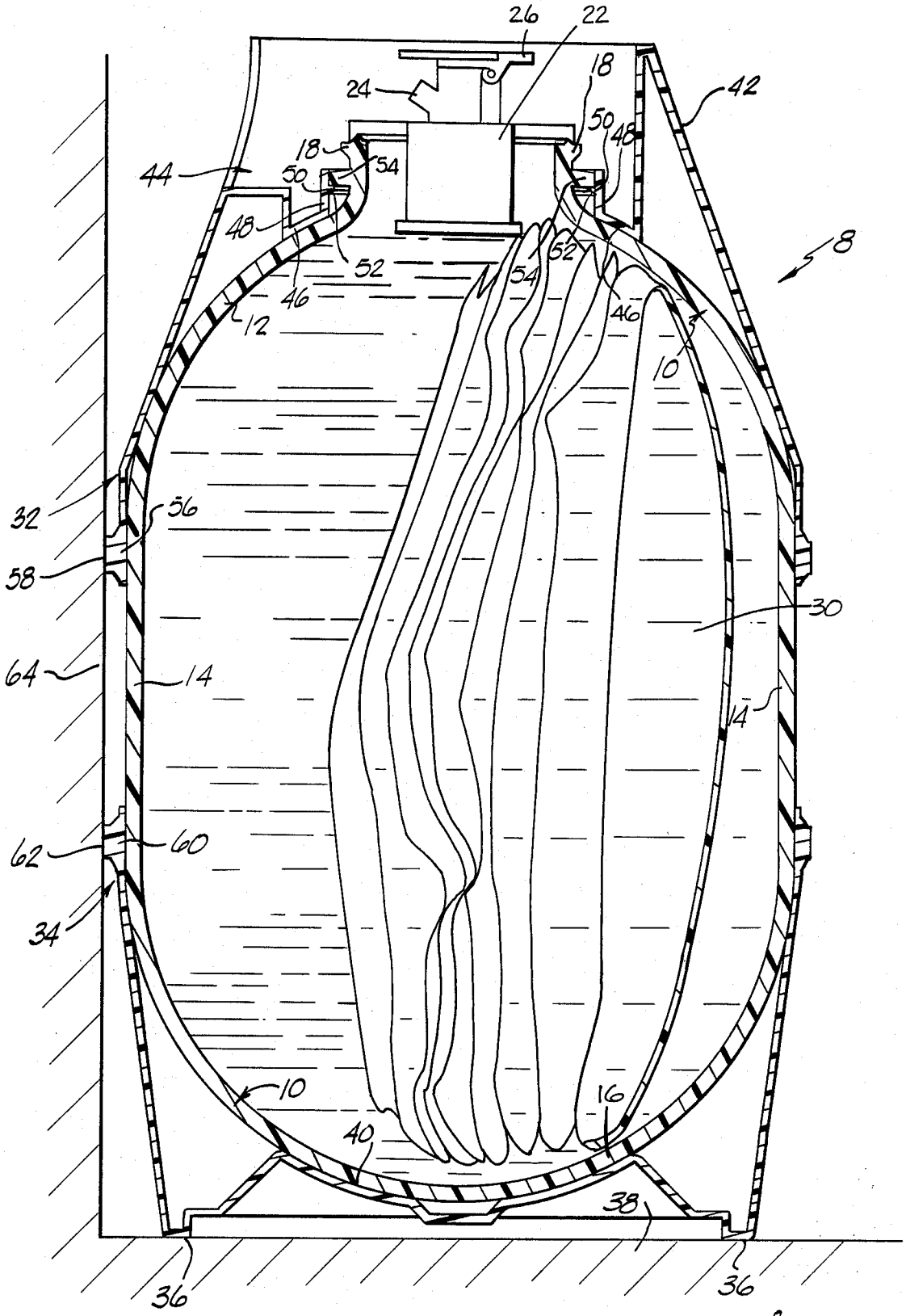
FIG. 1 is a view partially in section schematically illustrating a disposable package of this invention.

A preferred embodiment of the present invention is schematically illustrated generally in FIG. 1 and comprises a disposable package 8 comprising a blown hollow integral plastic container means 10, using a plastic material such as polyethylene terephthalate (PET), having hemispherical top portion 12, an annular cylindrical central portion 14 and a hemispherical bottom portion 16. A neck portion 18 defining an opening 20 is provided in the top portion. A dispensing means 22 comprising an assembly of a plurality of integrally molded plastic parts and having a pour nozzle 24 and a flow control handle 26 are mounted in the opening 20 after the container means has been filled with a suitable fluid, such as a liquid beverage which preferably is beer. An expandable pouch means 30, which is designed to expand according to a set program as the fluid is dispensed such as those described in U.S. Pat. No. 3,096,000 to Staley and U.S. Pat. No. 3,718,236 to Reyner et al., and preferably as described in the above-identified Dorfman and Dugan application, is inserted into the container means and, as explained below, as the expandable pouch means 30 expands, it provides the necessary forces to facilitate dispensing of the beer from the container means in any orientation of the container and to fill the headspace to maintain proper carbonation levels and/or pressure in the container. If necessary, a flexible hollow flow tube (not shown) but of the type illustrated in Reyner et al. may be positioned in the container means to ensure that all of the fluid is dispensed.

Protective and support members 32, 34, made of a relatively flexible molded plastic material, such as polyethylene, are attached to the container top portion 12 and bottom portion 16. Member 34 has an annular rim portion 36, which enables the container means 10 to be supported in a vertical attitude on a support surface 38, and a partially spherical portion 40 is engaged with the container bottom portion 16. Member 32 has an annular rim portion 42 which protects the dispensing means 22. A recess 44 in rim portion 42 provides clearance for dispensing the fluid from the nozzle 24. A partially spherical band portion 46 of the member 32 supportively engages the container end portion 12 adjacent to, but spaced from the neck portion 18. An annular portion 48 of member 32 has an annular projection 50 having a tapering surface 52 and cooperates with an annular projection 54 on container neck portion 18 for a purpose to be described below.

The member 32 is provided with an annular reinforcing band portion 56 and is provided with a generally planar surface 58 at a desired location. The member 34 is provided with an annular reinforcing band portion 60 and is provided with a generally planar surface 62 at a desired location. The planar surfaces 58 and 62 are aligned relative to each other so that they may be placed in contact with a surface 64, such as a shelf of a refrigerator, and remain in a relatively fixed position so that beer may be readily dispensed from the nozzle 24.

The protective and support member 32 is illustrated in FIG. 2 and comprises a first section 72 having an annular configuration adapted to contact the container 10, a second section 74 integral with the first section 72 and having an outer surface having a configuration generally of a frustum of a cone; a third section 76 integral with the second section 74 at a location of the second section having the smallest outside diameter and having an annular generally planar surface; a fourth section 78 integral with said third section 76 and having an outer surface having a configuration of a frustum of a cone with its largest diameter adjacent to the third section 76 and projecting inwardly in a direction generally toward the first section 72; a fifth section 46 integral with the fourth section 78 and having an inner surface 82 having a configuration of a frustum of a hemisphere and adapted to contact the container 10; a sixth section 48 integral with the fifth section 46 having an annular configuration and projecting outwardly in a direction generally toward the third section; and an annular projection 50 projecting inwardly and provided with a tapered surface 52 with the largest inner diameter of the tapered surface 52 being the closest to the fifth section 46. As described above in relation to FIG. 1, a recess 44, comprising portions of sections 74, 76 and 78, has a surface 86 and provides an opening in which a receptacle for fluid may be positioned.

Figure 3:
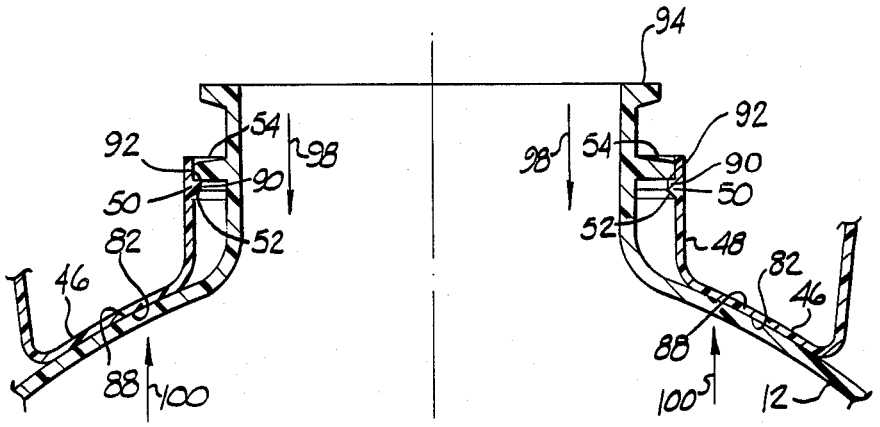
FIG. 3 is a view in section illustrating a locking means between the support member of FIG. 2 and a container.
Figure 4:
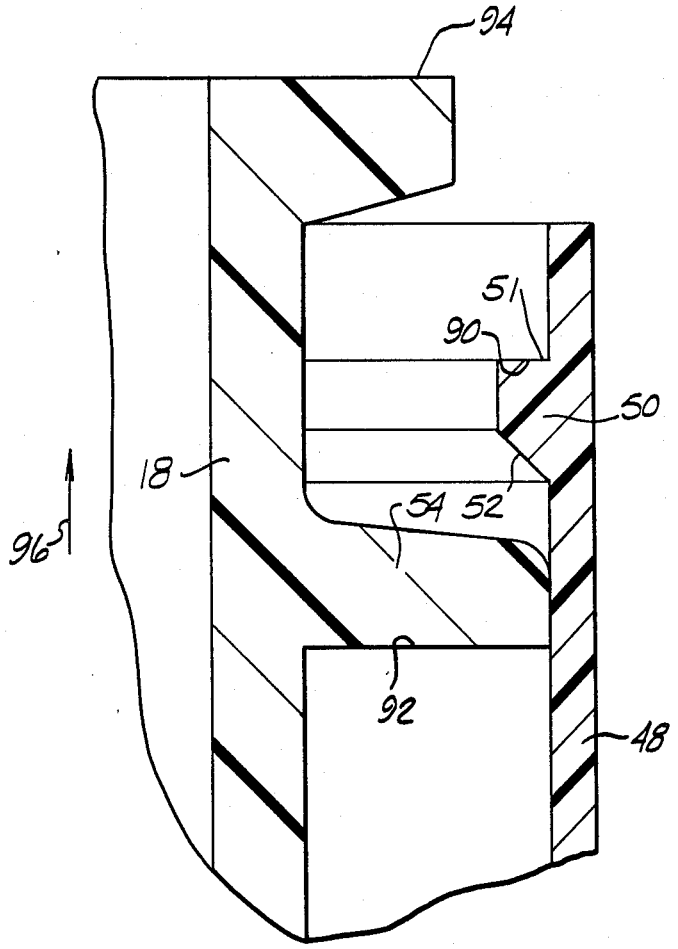
FIG. 4 is an enlarged view showing the relationship of FIG. 3 immediately prior to completion.

In FIGS. 3 and 4, there is illustrated a locking means for preventing relative linear movement between the container means 10 and the protective and support member 32. The assembled relationship is illustrated in FIG. 3 wherein the surface 82 of the fifth section 46 is in contact with the adjacent outer surface 88 of the container means 10, which surface 88 has an outer configuration of a frustum of a hemisphere and the surface 90 of the projection 50 is in contact with the surface 92 of the projection 54. The relationship of the various parts prior to the completed assembled relationship is illustrated in FIG. 4. An annular flange 94 on the neck 18 of the container means 10 has an outer diameter less than the inner diameter of the projection 50 so that as the container means 10 moves in the direction of the arrow 96, the flange 94 moves readily by the projection 50. However, the projection 54 on the neck 18 has an outer diameter greater than the inner diameter of the projection 50 so that, as the container means 10 moves in the direction of the arrow 96, the projection 54 moves into contact with the tapered surface 52. Continued movement of container means 10 in the direction of the arrow 96 results in movement of the projection 54 over the tapered surface 52. The container means 10 and therefore the projection 54 is formed from a relatively rigid plastic material and is not readily deformable. However, since the protective and support member 32 and therefore the projection 50 is formed from a plastic material with some degree of flexibility, the projection 50 will be compressed permitting the projection 54 to move in the direction of the arrow 96 until the assembled relationship illustrated in FIG. 3 has been reached. In some instances, it may be desirable to provide serrations or nicks (not shown) in the projection 50 in the areas 51 to facilitate the flexing of member 50 as the projection 54 passes over it. This will have no adverse effect in the regular operational characteristics between the projections 50 and 54. Relative linear movement between the protective and support member 32 and the container means 10 in a direction indicated by the arrow 98 is prevented by the contact between the surfaces 90 and 92. This contacting relationship between the surfaces 90 and 92 is very important since this contacting relationship provides the support for the filled container means when it is being carried by the handle, as described below. Relative linear movement between the protective and support member 32 and the container means 10 in a direction indicated by the arrow 100 is prevented by the contact between the surfaces 82 and 88. Also, this contacting relationship functions to support an upper disposable package when disposable packages are in nested relationship for shipping and commercial storage, as described below. Relative rotational movement between the container means 10 and support member 32 is prevented by the interference fit of the contacting surfaces 90 and 92. In some instances, it may be desirable to provide a positive mechanical stop, such as a detent and a projection or an adhesive, to prevent relative rotational movement between the container means 10 and the support member 32.

The means for providing the planar supporting surface 58 on the support member 32 is illustrated in FIGS. 5 and 5A and comprises a first leg portion 100 which in the preferred embodiment is integrally formed and projects outwardly in a radially inclined direction from the reinforcing band portion 56. A second leg portion 101 is integral with the first leg portion 100 and the reinforcing band portion 56. A reinforcing web 102 is integral with the first leg portion 100, the second leg portion 101 and a portion of the band portion 56. The bottom planar surface 58 of the second leg portions 101 is tangential to the reinforcing band portion 56 at 103. As illustrated in FIG. 5A, the second leg portion 101 has a generally rectangularly shaped cross-sectional configuration which is also the cross-sectional configuration of the first leg portion 100.

Figures 6, 6A:
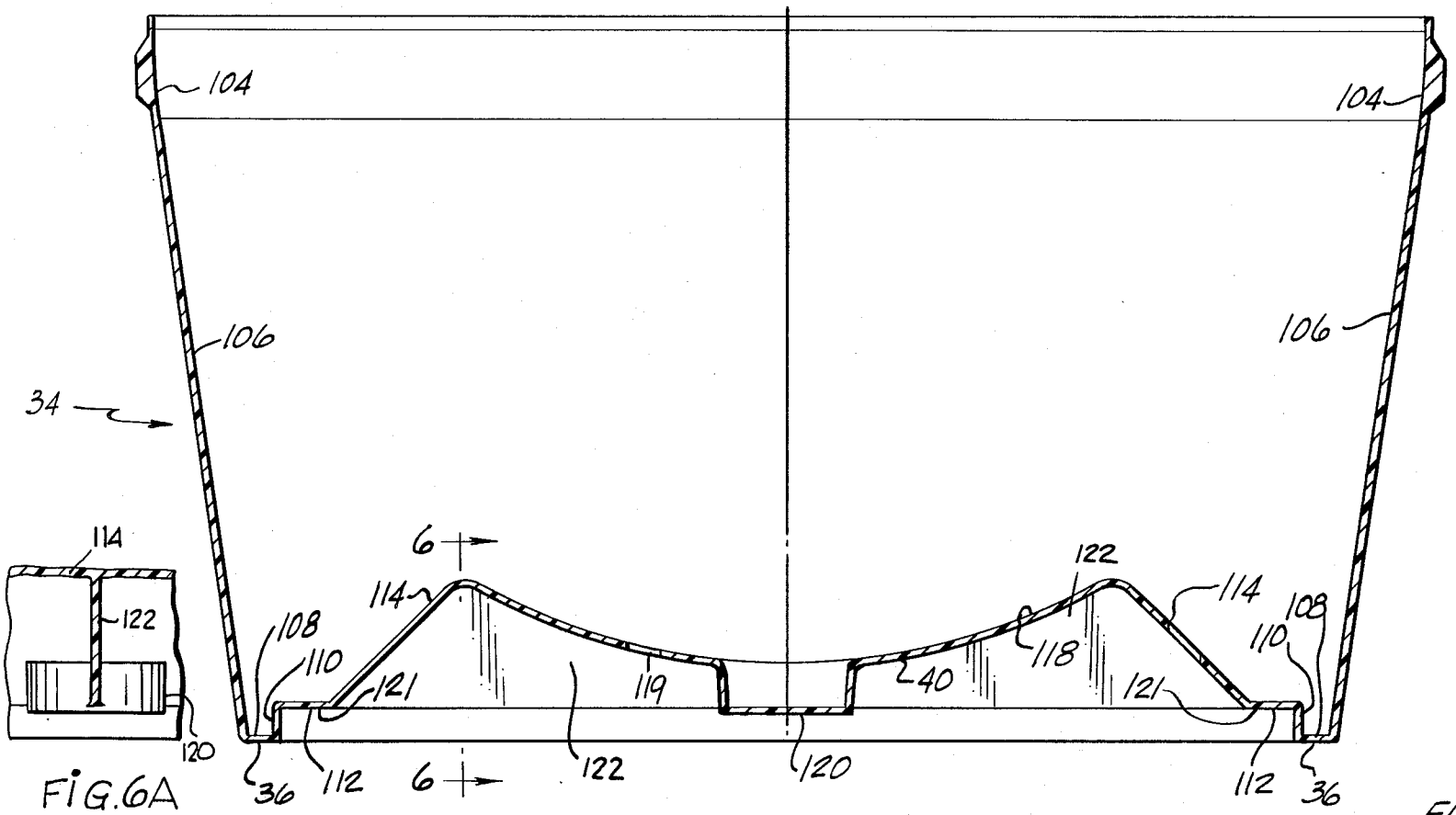
FIG. 6 is a view in section of the other of the protective and support members.
FIG. 6A is a cross-sectional view taken on the line 6A—6A of FIG. 6.

The protective and support member 34 is illustrated in FIG. 6 and comprises a first section 104 having an annular configuration adapted to contact the container means 10; a second section 106 integral with the first section 104 and having an outer surface having a configuration generally of a frustum of a cone; a third section 108 integral with the second section 106 at a location of the second section 106 having the smallest outside diameter and having an annular generally planar surface extending inwardly; a fourth section 110 integral with the third section 108 and having a cylindrical inner surface which is perpendicular to the third section; a fifth section 112 integral with the fourth section 110 and having an annular generally planar surface extending inwardly and parallel to said third section 108; a sixth section 114 integral with the fifth section 112 and having an outer surface having a configuration of a frustum of a cone with its largest diameter adjacent to the fifth section 112; and a seventh section 40 integral with the sixth section and having a spherical inner surface 118 adapted to contact a portion of the hemispherical bottom portion 16 of the container means 10. The seventh section 40 also is provided with a recess 120 which projects outwardly from the seventh section 40 adapted to receive any projections from the container means 10 resulting from the process by which the container is formed. The seventh section 40 has a bleed hole 119 to allow air to escape during the assembly of member 34 onto the container means 10. In some instances, it may be desirable to provide a plurality of bleed holes 119. Additionally, holes (not shown) similar to the bleed holes 119 can be provided in the third section 108 to drain any moisture which may collect therein. The third section 108 provides the surface 36 for supporting the container means 10 on the surface 38. The fifth section 112 provides a surface 121 for supporting a container means on the third section 76 of a protective and support member 32 as will be described below. The support member 34 is also provided with a plurality of reinforcing ribs 122, one of which is illustrated in FIG. 6A, which have portions integral with the sixth portion 114, the seventh portion 40 and the outwardly projecting portion of the recess 120. There are eight equidistantly spaced apart reinforcing ribs 122.

Figure 7:
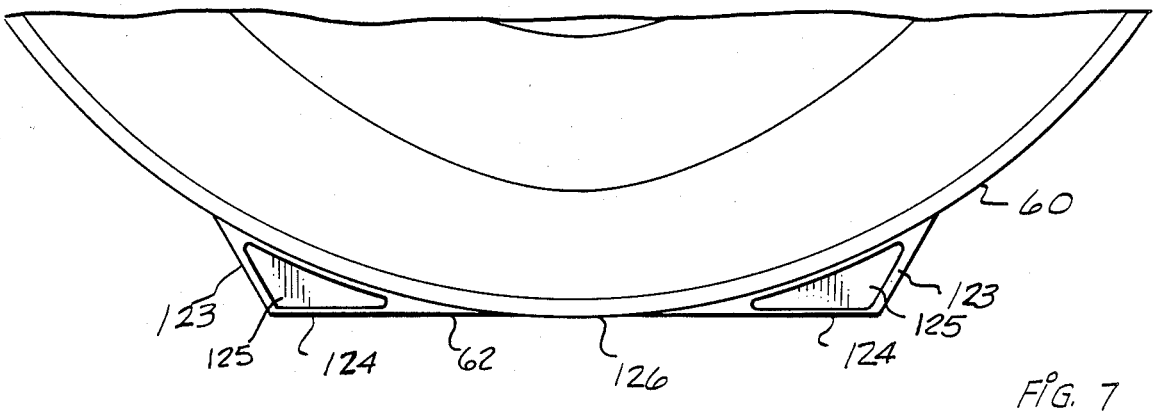
FIG. 7 is an end view of a portion of FIG. 6.

The means for providing the planar supporting surface 60 on the support member 34, which is similar to the means for providing the planar supporting surface 58 on the support member 32, is illustrated in FIG. 7 and comprises a first leg portion 123 which in the preferred embodiment is integrally formed and projects outwardly from the reinforcing band portion 60 in a radially inclined direction. A second leg portion 124 is integral with the first leg portion 123 and the reinforcing band portion 60. A reinforcing web 125 is integral with the first leg portion 123, the second leg portion 124 and a portion of the reinforcing band portion 60. The bottom planar supporting surface 60 of the second leg portions 124 is tangential to the reinforcing band portion 60 at 126. The first and second leg portions 123 and 124 have generally rectangularly shaped cross-sectional configurations similar to the first and second leg portions 100 and 101.

Figure 8:
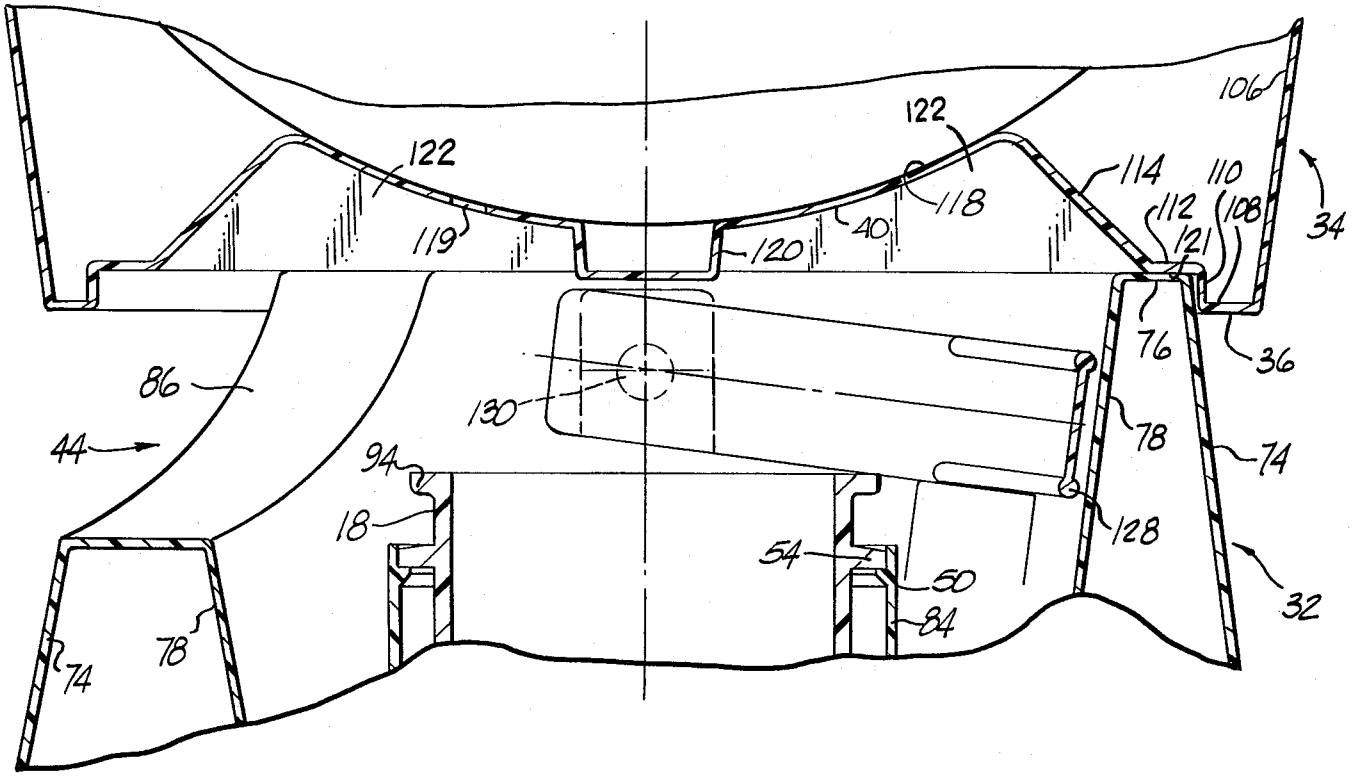
FIG. 8 is a partial view in section illustrating the nested condition.

In FIG. 8, there is illustrated the arrangement of the disposable packages when in commercial storage or in shipment (the dispensing means have been omitted for the sake of clarity). The disposable packages are mounted one on top of the other with the protective and support member 34 of one disposable package nested on top of the protective and support member 32 of another disposable package. As illustrated, the third section 76 of the protective and support member 32 is in contacting relationship with the fifth section 112 of the protective and support member 34 so as to support the upper disposable package on the lower disposable package. As illustrated in FIG. 3, the weight of the upper disposable package is transmitted onto the lower container through the contacting relationship between the surfaces 82 and 88. A handle 128 is also illustrated and is pivotally mounted on the fourth section 78 by pivot means 130. As illustrated in FIG. 3, the weight of the filled container when carried by the handle 128 is supported by the contacting relationship of the surfaces 90 and 92. The reinforcing ribs 122 provide a restraining force to prevent the outward deflection of the fifth section 112.

Figures 9, 10:
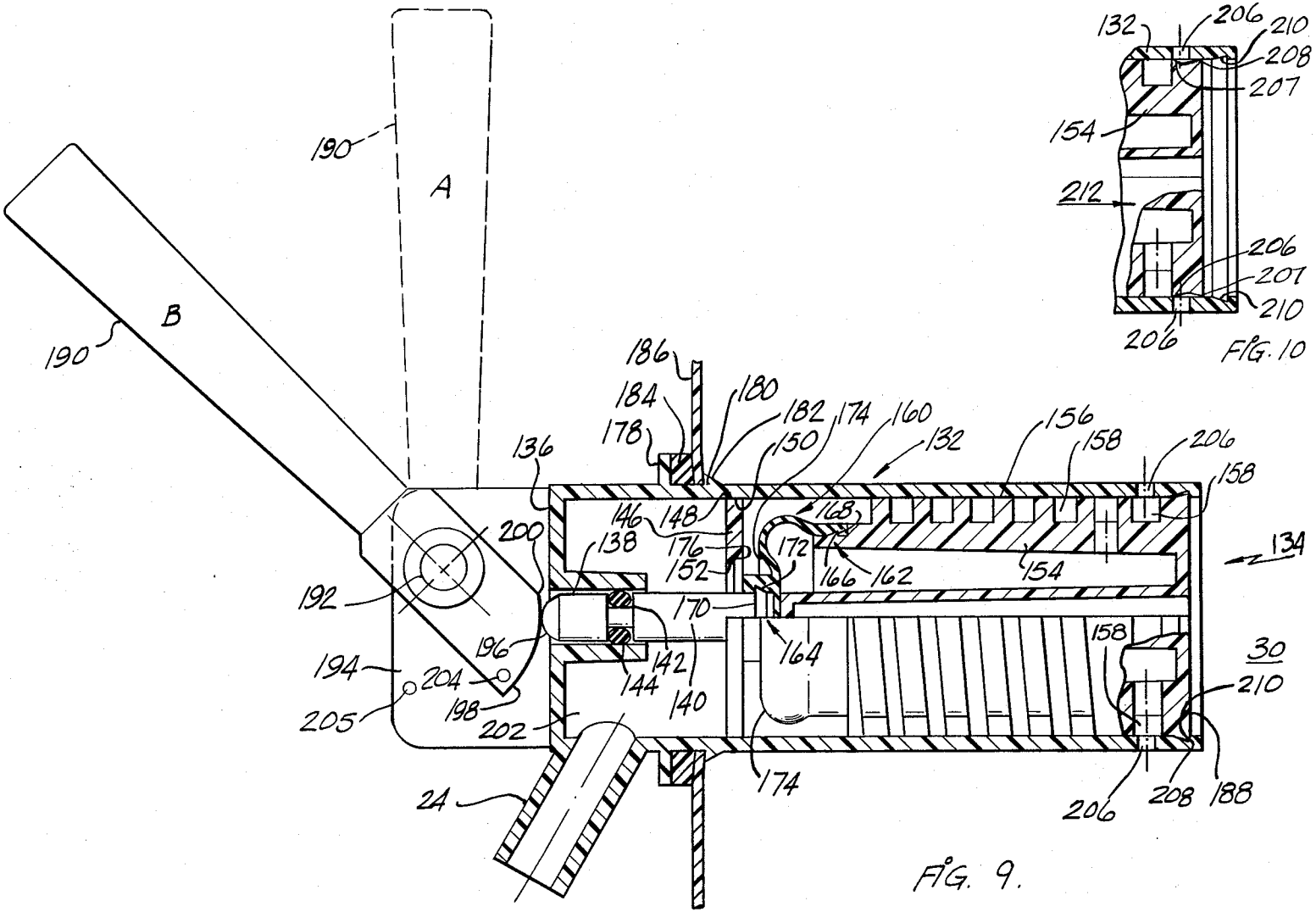
FIG. 9 is a view with parts in section of one type of dispensing means.
FIG. 10 is a partial view of FIG. 9 with parts located for shipping and storage.

A necessary part of the container 10 is some type of dispensing means so that the fluid may be removed as desired from the container means 10. One embodiment of the dispensing means is illustrated in FIG. 9 and comprises a hollow annular housing 132 having an open end 134 at one end thereof and an end wall 136 at the other end. The end wall 136 has a central passageway 138 having a generally cylindrical inner surface. A rod 140 is positioned in the passageway 138 for reciprocal movement therein. An annular groove 142 is formed in the rod 140 and a sealing gasket 144 is positioned in the groove so as to form a fluid tight seal between the rod 140 and the passageway 138. A partition 146 is located in the housing 132 with the annular outer surface 148 of the partition 146 in engagement with the inner surface 150 of the housing 132 so as to form a fluid tight seal therebetween. The partition 146 has a central opening 152 having a diameter greater than the diameter of the rod 140 for a purpose to be described below. A flow restrictor 154 is mounted in the housing 132 and is provided with a projecting spiral rib 156 in contact with the inner surface 150 of the housing 132 so as to form a spiral passageway 158 for the flow of fluid. A resilient sealing means 160 is connected at one end 162 to the flow restrictor 154 and at its other end 164 to the rod 140. As illustrated in FIG. 9, the resilient sealing means 160 is connected to the flow restrictor 154 by a snap fit wherein a projection 166 on the flow restrictor 154 is seated in a recess 168 in the resilient sealing means 160. A similar snap fit connection is provided between the resilient sealing means 160 and the rod 140 with a projection 170 on the rod 140 being seated in a recess 172 in the resilient sealing means 160. An annular sealing surface 174 is formed on the sealing means 160 and is adapted to be moved into and out of sealing engagement with the annular surface 176, surrounding the central opening 152 of the partition 146 as described below.

The housing 132 is provided with an integral outwardly projecting annular flange 178 and an integral outwardly projecting annular rib 180 having an outer tapering surface 182 having its smallest outer diameter closer to the open end 134. A seal washer 184 and a closure means 186 are positioned on the housing 132 between the flange 178 and the rib 180. The seal washer 184 functions to effect a fluid tight seal between the closure means 186 and the housing 132.

The means for reciprocating the rod 140 so as to move the sealing surface 174 into and out of engagement with the annular surface 176 is illustrated in FIG. 9 wherein the dispensing means is shown in an open position. In the closed position (not shown), the force due to the resilient nature of the sealing means 160 moves the sealing surface 174 into sealing engagement with the annular surface 176. The means for moving the rod 140 in the opposite direction to a position illustrated in FIG. 9 comprises a dispenser handle 190 rotatably mounted on a pivot 192 mounted in a pivot block 194. The rod 140 is provided with an arcuate surface 196 that projects outwardly from the end wall 136. The dispenser handle 190 has an arcuate surface 198 adapted to be in contact with the arcuate surface 196 of the rod 140. When the dispenser handle 190 is in a vertical position A, the arcuate surface 196 is in contact with the end 200 of the arcuate surface 198 so that the dispensing means is in a closed position (not shown) with the sealing surface 174 in sealing engagement with the annular surface 176 surrounding the central opening 152. When the dispenser handle 190 has been moved to position B, the arcuate surface 198 has gradually moved over the arcuate surface 196 so as to apply camming forces to the rod 140 to move sealing surface 174 out of engagement with the annular surface 176 and permit the flow of fluid through the spiral passageway 158, out between the space between the rod 140 and the central opening 152, into the chamber 202 and then out through the nozzle 24.

The dispensing means is assembled by sliding the sealing gasket 144, preferably an 0-ring, over the rod 140 until it is seated in the groove 142; the rod 140 is then pushed into the sealing means 160 until the projection 170 snaps into the recess 172; the flow restrictor 154 is pushed into the sealing means 160 until the projection 166 snaps into the recess 168 to form a sub-assembly. The partition 146 is then press fitted into the housing 132 and the sub-assembly inserted in the housing 132. The sealing gasket is then moved over the housing 132 and into contact with the flange 178. The housing 132 is then press fitted into the closure 186 which closure 186 is then sealing fitted onto the flange 94 of the container 10 (not shown). An opening 204 is provided in the dispenser handle 190 and an opening 205 is provided in the pivot block 194 so that when the dispenser handle is in the closed position A, a locking pin (not shown) may be inserted through the openings 204 and 205 to prevent movement of the dispenser handle 190. This is particularly important during shipment and commercial storage of the disposable package.

The location of the flow restrictor 154 in the housing 132 during shipment and commercial storage is illustrated in FIG. 10. The housing 132 is provided with a plurality of openings 206. As illustrated in FIG. 10, the flow restrictor 154 is provided with a generally cylindrical outer surface 207 in contact with the inner surface 150 of the housing 132 so as to seal off the openings 206. In this position, there is no passageway between the fluid in the container and the means 174 and 176 for supplying fluid to the nozzle 24 so that n fluid may flow from within the container to such means 174 and 176. The flow restrictor 154 is provided with an outwardly extending annular projection 208 and the housing 132 is provided with an annular recess 210 in its inner surface 15.. When it is desired to dispense fluid from the container means 10, the locking pin (not shown) is removed and the handle 190 is moved from the closed position A to the open position B. The movement of the handle A to the open position B moves the flow restrictor 154 in the direction of arrow 212 until the annular projection 208 snaps into the annular recess 210 and the flow restrictor 154 is locked in position. As illustrated in FIG. 9, when the flow restrictor 154 is in the locked position, the openings 206 are aligned with the spiral passageway 158 so that fluid may flow through the openings 206 into the spiral passageway 158.

Figure 12:
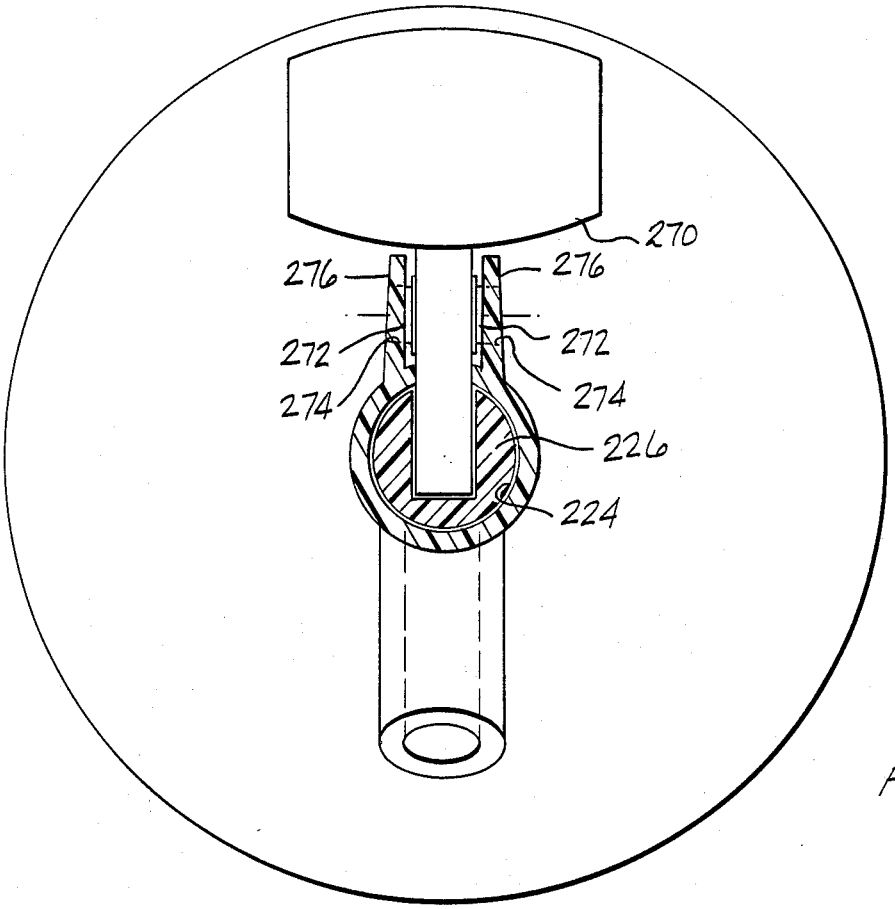
FIG. 12 is a cross-sectional view taken on the line 12—12 of FIG. 11.
Figures 11, 13, 14:
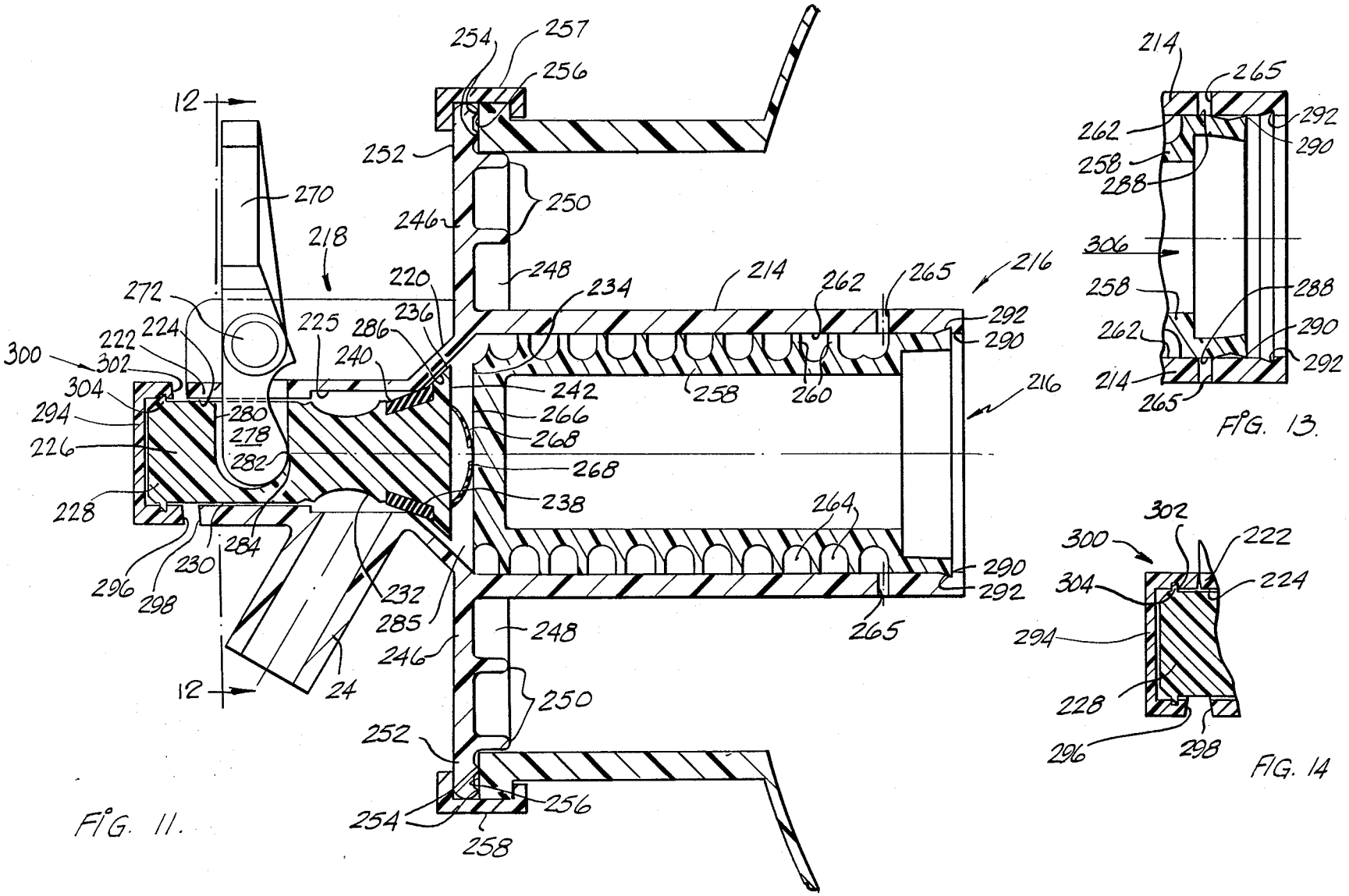
FIG. 11 is a view with parts in section of another type of dispensing means.
FIG. 13 is a partial view of FIG. 11 with parts located for shipping and storage.
FIG. 14 is an elevational view in cross-section of a flow modulator of this invention.

Another embodiment of the dispensing means is illustrated in FIGS. 11–13 and comprises a hollow annular housing 214 having an open end 216 at one end thereof and fluid flow control means 218 at the other end. The fluid flow control means 218 comprises an integral hollow conical section 220 extending from the housing 214 with an integral hollow generally annular member 222, extending from the conical section 220. The annular member 222 has a first inner generally cylindrical surface 224 and a second inner generally cylindrical surface 225 having an inner diameter greater than the inner diameter of the first generally cylindrical surface 224. A rod 226 is mounted in the member 222 for reciprocal movement therein and has a first section 228 having a generally cylindrical surface 230 in sealing but slidable contact with the first generally cylindrical surface 224. If desired, a groove (not shown) may be formed in the first section 228 with an O-ring gasket seated in the groove to form a fluid tight seal between the first inner generally cylindrical surface 224 and the first section 228. Spaced inwardly from the first section 228, the rod 226 is provided with an arcuate annular recess 232 so as to form an annular space between the second inner generally cylindrical surface 225 and the recess 232. Between the recess 232 and the rod's inner extremity 234, the rod 226 is provided with a generally tapering outer surface 236 having an annular recess 238 formed therein. A sealing gasket 240 is seated in the recess 238. The bottom of the rod 226 comprises a generally flat surface 242. An integral annular flange like member 246 projects outwardly from the housing 214 and has a rim 248 extending in a direction toward the open end 216. A plurality of ribs 250 provide reinforcement to the rim 248. As illustrated in FIG. 11, the rim 248 is loosely fitted into the neck 18 of the container means 10. An integral annular portion 252 extends outwardly from the flange like member 246 and is provided with sealing means 254 in contact with the surface 256 of the flange 94 on the neck 18 of the container 10. Annular clamping means 257 are used to retain the assembly and ensure sealing engagement between the sealing means 254 and the surface 256.

A flow restrictor 258 is mounted in the housing 214 and is provided with a projecting spiral rib 260 in contact with the inner surface 262 of the housing 214 so as to form a spiral passageway 264 for the flow of fluid therethrough. The housing 214 is provided with a plurality of openings 265 so that fluid may flow from within the container 10 through the openings 265 into the spiral passageway 262. The flow restrictor has a flat end surface 266 spaced a short distance away from flat surface 242. Resilient means 268 are positioned between and in contact with the flat surfaces 242 and 266. In the preferred embodiment, the resilient means 268 comprise two leaf spring members integrally molded with the rod 226 and in contact with the flat surface 266. If desired, the resilient means could be integral with the flow restrictor 258 and in contact with the flat surface 242.

The spiral passageway 264 functions to reduce the pressure of the fluid as it flows through the passageway 264 and into the space between the flat end surface 266 of the flow restrictor 258, the flat surface 242 and the conical section 220. The length and cross-sectional area of the spiral passageway 264 will vary in accordance with the type of fluid, such as a beverage, in the container means 10 and the pressure being developed within the container means 10 by the pressure pouch 30.

A handle means is illustrated in FIGS. 11 and 12 and comprises a handle 270 rotatably mounted by a pivot means 272 seated in opening 274 in blocks 276 extending upwardly from the annular member 222. The lower portion 278 of the handle 270 is positioned in a cavity 280 in the rod 226 and has a cam surface 282 adapted to contact the wall 284 of the cavity 280. In the closed position with the handle 270 in an upright vertical position, illustrated by the solid lines in FIG. 11, the sealing gasket 240 is in contact with the intersection of the second generally cylindrical surface 225 and the inner surface 286 of the conical section 220 by the force exerted by the resilient means 268. When the handle 270 is moved to the open position (not shown), the cam surface 282 acts against the wall 284 to move the rod 226 against the force exerted by the resilient means 268 to move the sealing member 240 out of engagement with the intersection of the second generally cylindrical surface 225 and the inner surface 286 of the conical section 220. When the handle 270 is in the open position, fluid from within the container 10 will flow through openings 265 into the spiral passageway 264, into the space 285 between the flat surface 242 and 246 within the conical section 220, through the opening between the sealing member 240 and the intersection between the second generally cylindrical surface 225 and the inner surface 286 into the recess 232 and then out through the nozzle 24.

The location of the flow restrictor 258 in the housing 214 during shipment and commercial storage is illustrated in FIG. 13. The housing 214 is provided with a plurality of openings 265. As illustrated in FIG. 13, the flow restrictor 258 is provided with a generally cylindrical outer surface 288 in contact with the inner surface 262 of the housing 214 so as to seal off the openings 265. The flow restrictor 258 is provided with an outwardly extending annular projection 290 and the housing 214 is provided with an annular recess 292 in its inner surface 262. In the position illustrated in FIG. 13, there is no passageway between the fluid in the bottle and the means 240, 225 and 286 for supplying fluid to the nozzle 24 so that no fluid may flow from within the container to such means 240, 225 and 286. The flow restrictor 258 is held in the position illustrated in FIG. 13 by a flow modulator 294 which is provided with a cam surface 296 opposite to a cam surface 298 on the end of the annular member 222. The flow modulator 294 is mounted on the end of the first section 228 of the rod 226 by means 300 which allow the actuator to be rotated but prevented from movement in an axial direction. The means 300 comprises a groove 302 in the flow modulator 294 and an annular rib 304 on the first section 228. The rib 304 is dimensioned to allow the modulator to be pushed over it and snap into the illustrated position. The position of the flow modulator 294 during shipping and commercial storage is illustrated in FIG. 14 wherein the greatest extent of the cam surface 296 is located opposite to and in contact with the greatest extent of the cam surface 298. In some instances, a positive mechanical stop, such as a detent means, may be used to hold the flow modulator 294 in the position illustrated in FIG. 13 so that an extra positive force is required to move the flow modulator to an open position. When it is desired to move the flow restrictor 258 into an operable location, the flow modulator 294 is rotated so as to place the least extent of the cam surface 296 opposite to but spaced from the cam surface 298. This permits the handle 270 to be rotated which functions to move the rod 226 toward the flow restrictor 258 and to move the flow restrictor 258 in the direction of arrow 306 until the annular projection 290 snaps into the annular recess 292 and the flow restrictor 258 is locked in position. The force exerted by the handle 270 on the rod 226 to move the flow restrictor 258 must be greater than the force exerted by the pressure on the fluid in the container on the flow restrictor 258. As illustrated in FIG. 11, the flow restrictor 258 has been moved into the locked position with the openings 265 aligned with the spiral passageway 264 so that fluid may flow through the openings 265 into the spiral passageway 264 and the handle 270 has been returned to its upright closed position.

In most instances, it is most convenient, in dispensing fluid from the bottle, to be able to move the handle 270 between a fully opened and a fully closed position. When the fluid in the bottle is a carbonated beverage, particularly if the beverage is beer, moving the handle to a fully opened position may produce some undesired effects such as too much foam. To compensate for this, the flow modulator 294 is rotated to some position between those illustrated in FIGS. 11 and 14 so as to limit the movement of the rod 226 in response to the rotation of the handle 270 to control the size of the opening between the sealing member 240 and the intersection between the second generally cylindrical surface 225 and the inner surface 286 so as to eliminate the undesirable effects and still permit the desirable operation of the handle 270 between a fully opened and a fully closed position.

Figure 15:
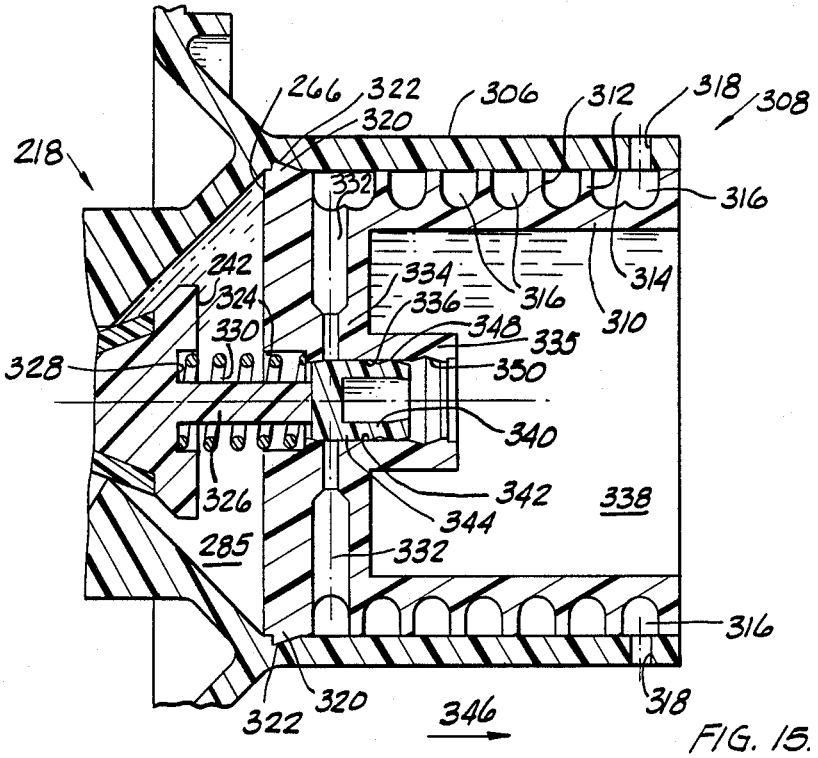
FIG. 15 is a view with parts in section of a portion of another type of dispensing means with parts located for shipping and storage.
Figure 16:
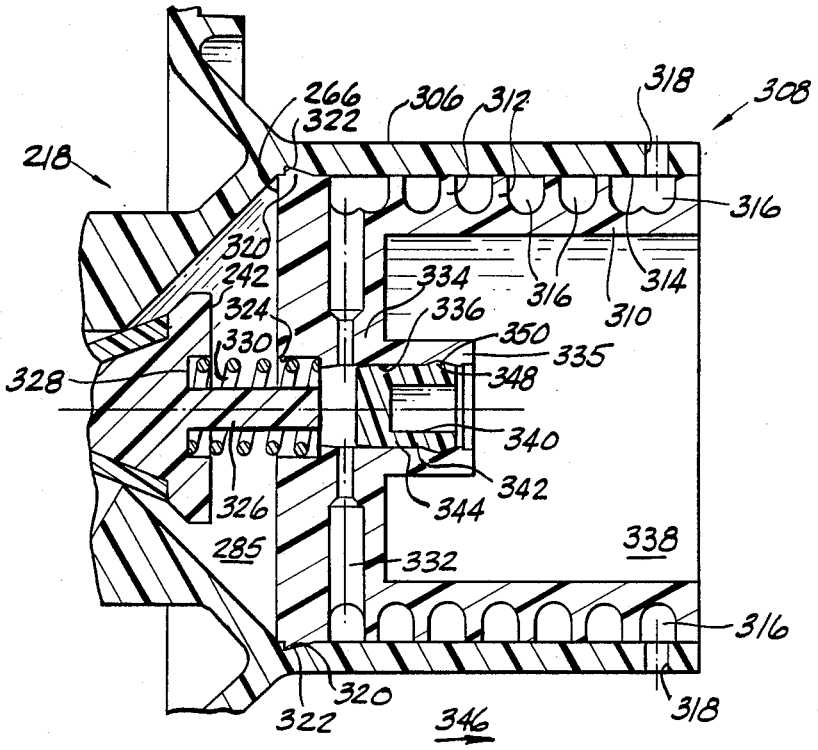
FIG. 16 is a view similar to FIG. 15 with parts located so that fluid may be dispensed from the container.

Another embodiment of the dispensing means is illustrated in FIGS. 15 and 16 and comprises a hollow annular housing 306 having an open end 308 at one end thereof and fluid flow control means 218 at the other end. Since the dispensing means illustrated in FIG. 15 has the same fluid control means 218 including the handle 270 and the flow modulator 294 and other associated parts as illustrated in FIG. 11, a detailed showing of these parts has been omitted in FIG. 15.

A flow restrictor 310 is mounted in the housing 306 and is provided with a projecting spiral rib 312 in contact with the inner surface 314 of the housing 306 so as to form a spiral passageway 316 for the flow of fluid therethrough. The housing 306 is provided with a plurality of openings 318 so that fluid may flow from within the container 10 through the openings 318 into the spiral passageway 316. An annular projection 320 on the flow restrictor 310 is seated in an annular recess 322 in the housing 306 to hold the flow restrictor 310 in proper relationship within the housing 306. The flow restrictor 310 has a flat end surface 266 having a central cylindrical recess 324. The flat surface 242 in FIG. 15 differs from that in FIG. 11 in that it is provided with a rod 326 projecting therefrom and with an annular recess 328 surrounding the rod 326. A coil spring 330 is seated in the recesses 324 and 328 to provide resilient means which function in the same way as the resilient means 268 illustrated in FIG. 11. The flow restrictor 310 is provided with a plurality of radially extending passageways 332 providing fluid communication between the spiral passageway 316 and the space 285, as described below.

The means for ensuring that there is no passageway between the fluid in the container and the means for opening and closing the passageway leading to the nozzle until it is desired to use the dispensing means for the first time to dispense fluid from the container in FIGS. 15 and 16 differs from such means illustrated in FIGS. 9 and 10 and FIGS. 11 and 13. As illustrated in FIG. 15, the end wall 334 of the flow restrictor 310 is provided with an inwardly directed projection 335 having a central opening 336 extending from the recess 324 to the interior 338 of the flow restrictor 310. A plug 340 is mounted in the central opening 336 and has an outer surface 342 in contact with the inner surface 344 of the opening 336 so as to form a fluid tight seal therebetween. During shipping and storage, the plug 340 is located as illustrated in FIG. 15 wherein the outer surface 342 of the plug 340 covers the ends of the radial passageways 332 so that there is no passageway extending between the fluid within the container and the fluid flow control means 218. The pressure of the fluid within the container acts against the plug 340 to urge the plug 340 against the rod 326 to ensure that the outer surface 342 of the plug 340 covers the ends of the passageways 332.

When it is desired to use the dispensing means for the first time, the flow modulator 294 is rotated so as to place the least extent of the cam surface 296 opposite to but spaced from the cam surface 298. This permits the handle 270 to be rotated which functions to move the rod 326 against the plug 340 to move the plug 340 in the direction of the arrow 346 until the annular projection 348 on the plug 340 snaps into the recess 349 in the end wall 334. The force required to move the plug 340 against the force exerted by the pressure on the fluid in the container is substantially less than the force required to move the flow restrictors 154 of FIG. 9 and 258 of FIG. 11. This is because the cross-sectional area of the plug 340 is substantially less than the cross-sectional areas of the flow restrictors 154 and 258. After the plug 340 has been moved to the position illustrated in FIG. 15, the flow modulator is rotated to the desired intermediate location so that the handle 270 may be moved between a fully opened position and a fully closed position as described above.

Figure 17:
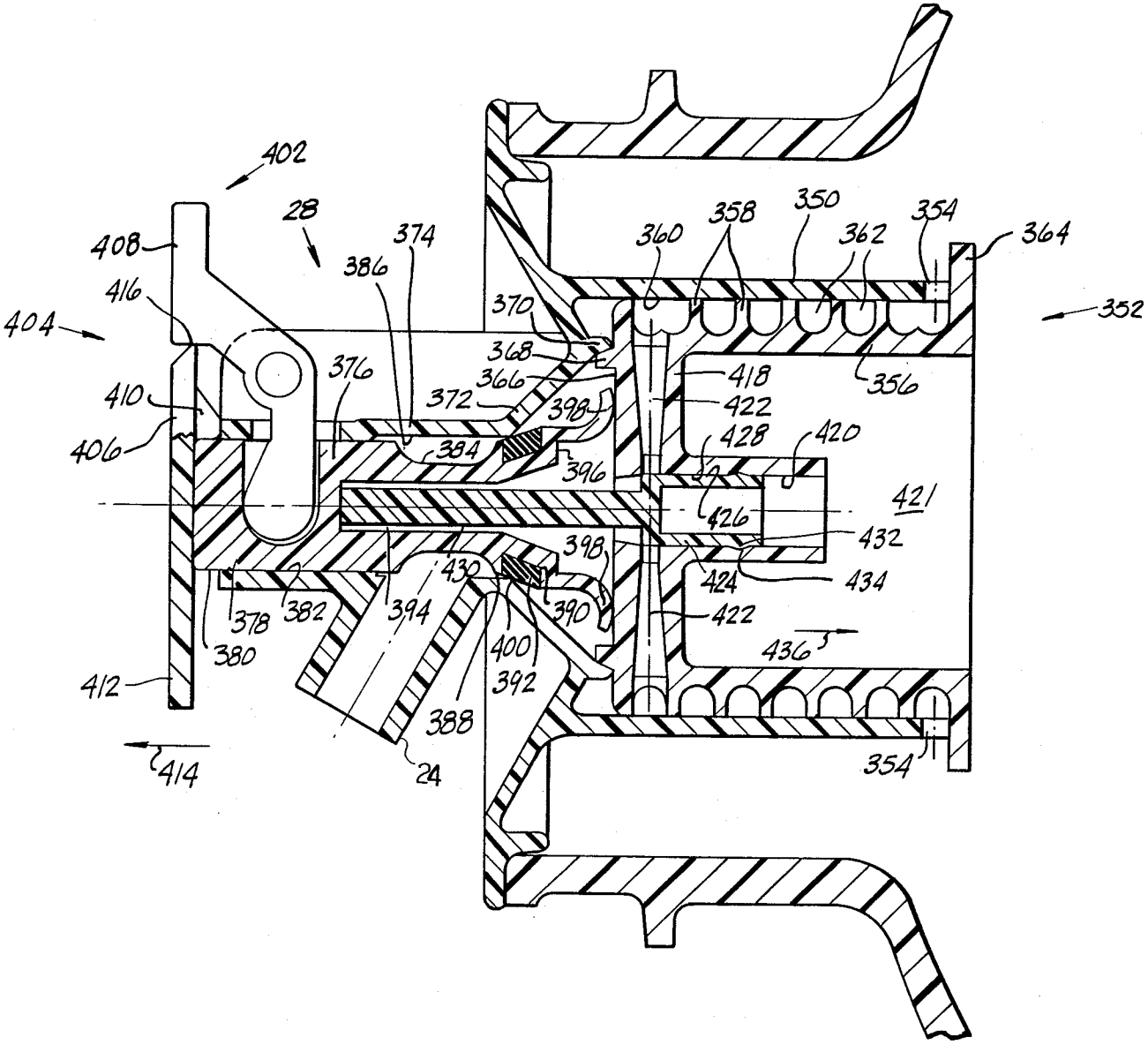
FIG. 17 is a view with parts in section of another type of dispensing means with parts located for shipping and storage.
Figure 18:
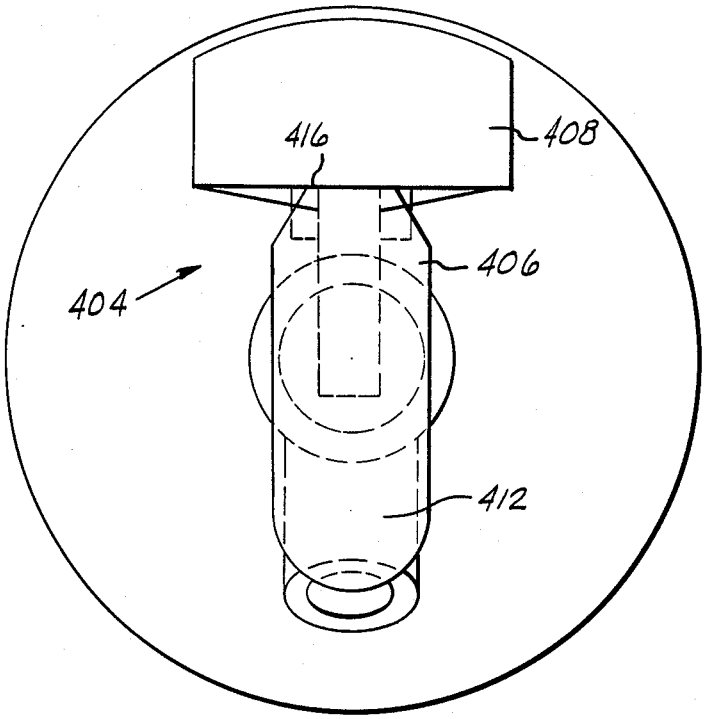
FIG. 18 is a front end view of the dispensing means of FIG. 17.

Another embodiment of the invention is illustrated in FIGS. 17 and 18 and comprises a hollow annular housing 350 having an open end 352 at one end thereof and fluid flow control means 28 at the other end. A pair of open ended slots 354 are formed adjacent to the open end 352 of the housing 350.

A flow restrictor 356 is mounted in the housing 350 and is provided with a projecting spiral rib 358 in contact with the inner surface 360 of the housing 350 so as to form a spiral passageway 362 for the flow of fluid therethrough. The flow restrictor 356 is provided with a flange 364 which contacts the end of the housing 350 so that fluid may flow from within the container 10 through the slots 354 into the spiral passageway 362. The end surface 366 of the flow restrictor 356 is provided with an annular projecting rib 368 which is located so as to contact and mate with an annular inwardly projecting rib 370 of the housing 350 so as to form a fluid tight seal therebetween.

The fluid flow control means 28 comprises an integral hollow conical section 372 extending from the housing 350 with an integral hollow generally annular member 374 extending from the conical section 372. A rod 376 is mounted in the member 374 for reciprocal movement therein and has a first section 378 having a generally cylindrical surface 380 in sealing but slidable contact with the generally cylindrical inner surface 382 of the annular member 374. If desired, a groove (not shown) may be formed in the first section 378 with a conventional O-ring gasket seated in the groove to form a fluid tight seal between the generally cylindrical surface 382 and the first section 378. Spaced inwardly from the first section 378, the rod 376 is provided with an arcuate annular recess 384 so as to form an annular space between the inner generally cylindrical surface 386 and the recess 384. Between the recess 384 and the rod's inner extremity, the rod 376 is provided with a generally tapering outer surface 388 having an annular recess 390 formed therein. A sealing gasket 392 is seated in the annular recess 390. The rod 376 has an inner annular cavity 394 formed therein and terminates in an annular rim 396. A pair of leaf springs 398 extend from the annular rim 396 and bear against the surface 366 of the flow restrictor 356. In normal operation, the leaf springs urge the rod 376 to a closed position with the sealing gasket 392 in sealing relationship with the annular portion 400 of the conical section 372.

Handle means 402 are provided. The means for preventing movement of the handle means 402 to move the rod 376 is illustrated in FIGS. 17 and 18, a locking means 404 comprising a member 406 is integrally formed on the handle 408. The member 406 is provided with a projection 410 extending inwardly toward the flow restrictor 356 and is provided with a mating surface in contact with the top outer surface of rod 376. In the position illustrated in FIGS. 17 and 18, the member 406 prevents rotation of the handle 408 so that the rod 376 cannot be moved toward the flow restrictor. When it is desired to dispense fluid from the container 10 for the first time, the lower portion 412 of the member 406 is grasped and moved outwardly in the direction indicated by the arrow 414 so as to break the member 406 away from the handle 408 along the juncture 416. The member 406 also serves as positive identification that the disposable package has not been tampered with.

The end wall 418 of the flow restrictor is provided with a central annular opening 420 extending from the surface 366 to the interior 421 of the flow restrictor. A plurality of radially extending passageways 422 are provided in the end wall 418 to provide fluid communication between the spiral passageway 362 and the central opening 420. A plug 424 is mounted in the central opening 420 and has an outer surface 426 in contact with the inner surface 428 of the opening 420 so as to form a fluid tight seal therebetween. During shipping and storage, the plug 424 is located as illustrated in FIG. 17 wherein the outer surface 426 of the plug 420 covers the ends of the radial passageways 422 so that there is no passageway extending between the fluid within the container and the fluid flow control means 28. A member 430 extends from the plug 424 and abuts against the rod 376. The pressure of the fluid within the container acts against the plug 424 to urge the plug 424 against the rod 376 to ensure that the outer surface 426 of the plug 420 covers the ends of the passageways 422. If desired, additional means, such as a projection 432 on the plug 424 seated in a recess 434 in the inner surface 428, may be used to position the plug 424.

When it is desired to use the dispensing means for the first time, the member 406 is rotated so as to break the member 406 away from the handle 408. This permits the handle 408 to be rotated which functions to move the rod 376 against the plug 424 to move the plug 424 in the direction of the arrow 436 until the outer surface 426 moves so as to open the passageways 422 to the central opening 420. The force required to move the plug 424 to an opened position is slightly greater than the force required to move the plug 340 in FIG. 15 to an open position, but is substantially less than the force required to move the flow restrictors 154 and 258 of FIGS. 9 and 11 to the open position.

In the presently preferred embodiment of the invention, the container means has an overall longitudinal extent of about 15.5 inches and the annular cylindrical portion 14 has an outer diameter of about 9.0 inches and has a longitudinal extent of about 13.5 inches, an average wall thickness of about 0.030 inches and the inner diameter of the opening 20 of about 2.5 inches. When the beverage is beer, the expandable pouch means is designed to maintain a pressure on the beer within the container means of between about 18 and 25 psig. The dispensing means illustrated in FIG. 17 has an overall length of about 3.0 inches, an outside diameter of the flange like member of about 3.0 inches and the housing 350 has an outer diameter of about 1.63 inches. The beer is dispensed at a rate of about 0.50 gallons per minute. However, the foregoing dimensions are given for illustration purposes only since those skilled in the art will make the various components of any shape or size to provide a desired service. It is the cooperation between the various structures to accomplish the various functions that provides the inventive concepts of this application. This is also the same in relationship to the materials used. Economic considerations and ease in handling dictate the use of a plastic material as described above.

While illustrative and presently preferred embodiments of the invention has been described in detail herein, it is to be understood that the inventive concepts may be otherwise variously embodied and employed and that the appended claims are intended to be construed to include such variations except insofar as limited by the prior art.

What is claimed is:

1. Apparatus for use in dispensing a fluid from a container comprising:

a container means having a fluid contained therein;

said container means having an opening therein for filling said container means with fluid;

means for closing said opening;

said means for closing said opening also including dispensing means located in said opening so that fluid may be dispensed from said container means;

said dispensing means including a passageway leading to a nozzle through which fluid is dispensed from said container means;

means for permitting partial dispensing of said fluid out of said container means without substantially degrading the quality of said fluid remaining in said container means, said means including means completely within said container means for maintaining the pressure within said container means between a desired range of pressures until substantially all of said fluid has been dispensed;

means for securing said dispensing means to said container means with a fluid tight seal between said securing means, said dispensing means and said container means;

said dispensing means including means for opening and closing said passageway leading to a nozzle through which fluid is dispensed from said container means;

means for forming a fluid tight seal between said means for opening and closing said passageway leading to said nozzle and the interior of said container means;

means for removing said fluid tight seal between said means for opening and closing said passageway leading to said nozzle and the interior of said container means so that said fluid may be dispensed from said container means through said dispensing means;

said means for forming a fluid tight seal between said means for opening and closing said passageway leading to said nozzle and the interior of said container means comprises:

a hollow housing;

a member having at least one opening therein leading to a passageway therein for the flow of fluid therethrough mounted in said housing;

at least one opening in said housing so that fluid from inside said container may flow through said at least one opening in said member and into said passageway of said member;

means for positioning said member relative to said housing so that said at least one opening in said member and said at least one opening in said housing are out of alignment so that fluid may not flow out of said container through said openings;

means for moving said member relative to said housing to move said at least one opening in said member into alignment with said at least one opening into alignment with said at least one opening in said housing so that fluid may flow out of said container means; and a flow modulator for movement between a first position for preventing movement of said means for moving said member and a second position permitting movement of said means for moving said member.

2. Apparatus as in claim 1 and further comprising:
means for positioning said flow modulator to control the size of said passageway leading to said nozzle.

3. A disposable package for use in marketing fluids comprising:
a hollow integral plastic container means for holding fluid and having a single opening for filling said container with fluid;
packaging means for holding said container means;
means for closing said opening;
said means for closing said opening also including means for dispensing fluid from said container means while said opening is closed;
self generating pressure applying means contained in a single pouch which is inserted into said container means through said single opening prior to its being closed for exerting a force on said fluid urging said fluid out of said container means;
means for maintaining the pressure generated by said pressure generating means at all times within a desired range of pressures, said range of pressures being substantially even to but slightly above the natural carbonation pressure of said fluid;
means for reducing the pressure on said fluid as said fluid flows through said dispensing means so that the pressure on said fluid as it issues from said dispensing means is less than said desired pressures in said container means;
said packaging means comprises at least two separate members secured to said container means for supporting said container means in one plane or in another plane perpendicular to said one plane;
means on one of said members cooperating with means on said container means for preventing relative linear movement between said one member and said container means comprising a projection on said one member in contact with a projection on said container means and a surface on said one member in contact with a surface on said container means;
said opening in said container means comprises a circular passageway having one end opening into said container means and the other end opening out of said container means;
said projection on said one member is annular and projects inwardly from said member;
said projection on said container means is annular and projects outwardly from said container means; and
said projection on said one member is closer to said one end of said passageway than said projection on said container means is when said one member and said container means are in assembled relationship.

4. A disposable package as in claim 3 wherein:
the inner diameter of said projection on said one member is less than the outer diameter of said projection on said container means; and
means are provided to allow said projection on said container means to move over said projection on said one member during the assembly of said one member and said container means.

5. A disposable package as in claim 4 wherein said means allowing said projection on said container means to move over said projection on said one member comprises:
an inclined inner surface on said projection on said one member; and
said inclined surface having its greatest inner diameter adjacent to said one end opening of said passageway.

6. A disposable package as in claim 5 wherein said contacting surfaces comprise:
an inner surface of said projection on said one member which is in contact with an outer surface of said projection on said container means.

7. A disposable package as in claim 6, wherein:
said container means has a bottom portion having a generally hemispherical configuration, a central portion having a generally annular configuration and a top portion having a generally hemispherical configuration.

8. A disposable package as in claim 7 wherein:
said inner surface of said one member is a frustum of a hemisphere and said outer surface of said container means is a frustum of a hemisphere.

9. A disposable package for use in marketing fluids comprising:
a hollow integral plastic container means having an opening for filling said container means with fluid and having a fluid contained therein;
packaging means for holding said container means;
means for closing said opening;
said means for closing said opening also including means for dispensing fluid from said container means;
pressure generating means inside said container means for exerting a force on said fluid urging said fluid out of said container means;
means for maintaining the pressure generated by said pressure generating means at all times within a desired range of pressures, said range of pressures being substantially even to but slightly above the natural carbonation pressure of said fluid;
means for reducing the pressure on said fluid as said fluid flows through said dispensing means so that the pressure on said fluid as it issues from said dispensing means is less than said desired pressures in said container means;
said packaging means comprises at least two separate members secured to said container means for supporting said container means in one plane or in another plane perpendicular to said one plane;
means for securing said dispensing means in said opening of said container means;
said dispensing means projecting outwardly from said opening;
said one member having a generally annular portion projecting outwardly from said container means for a distance greater than the distance said dispensing means projects outwardly from said container means;
a nozzle on said dispensing means;
a recess formed in said generally annular portion, said recess being aligned with said nozzle, so that a fluid may be dispensed from said container means;
said one member having a first section in contact with said container means at a location adjacent to said central portion of said container means;
said one member having a second section integral with said first section;
said second section having an outer surface having a configuration generally of a frustum of a cone;
said one member having a third section integral with said second section at a location of said second section having the smallest outer diameter;

said third section having an annular generally planar outer surface;

said one member having a fourth section integral with said third section;

said fourth section having an outer surface having a configuration generally of a frustum of a cone with its largest, outer diameter adjacent to said third section, said fourth section projecting inwardly in a direction toward said first section;

said one member having a fifth section integral with said fourth section;

said fifth section having an inner surface in contact with said container;

said one member having a sixth section integral with said fifth section;

said sixth section projection outwardly from said fifth section;

said sixth section having an inwardly directed annular projection in contact with an outwardly directed annular projection on said container means; and said recess being formed in parts of said second, third and fourth section.

10. A disposable package as in claim 9 wherein:

said contacts between said fifth section and said container means and between said projection on said sixth section and the projection on said container means function to prevent relative linear movement between said one member and said container means.

11. A disposable package for use in marketing fluids comprising:

a hollow integral plastic container means for holding fluid and having a single opening for filling said container with said fluid;

packaging means for holding said container means;

means for closing said opening;

said means for closing said opening also including means for dispensing fluid from said container means while said opening is closed;

self-generating pressure applying means contained in a single pouch which is inserted into said container means through said single opening prior to this being closed for exerting a force on said fluid urging said fluid out of said container means;

means for maintaining the pressure generated by said pressure generating means at all times within a desired range of pressures, said range of pressures being substantially even to but slightly above the natural carbonation pressure of said fluid;

said packaging means comprises at least two separate member secured to said container means for supporting said container means in one plane or in another plane perpendicular to said one plane;

means on one of said members cooperating with means on said container means for preventing relative linear movement between said one member and said container means comprising a projection on said one member in contact with a projection on said container means and a surface on said one member in contact with a surface on said container means;

said opening in said container means comprises a circular passageway having one end opening into said container means and the other end opening out of said container means;

said projection on said one member is annular and projects inwardly from said member;

said projection on said container means is annular and projects outwardly from said container means; and said projection on said one member is closer to said one end of said passageway than said projection on said container means is when said one member and said container means are in assembled relationship.

12. A package as in claim 11 and further comprising:

handle means on said one member for carrying said container means from place to place.

* * * * *

UNITED STATES PATENT AND TRADEMARK OFFICE

CERTIFICATE OF CORRECTION

PATENT NO. : 4,867,348

DATED : September 19, 1989

INVENTOR(S) : Jan L. Dorfman

It is certified that error appears in the above-identified patent and that said Letters Patent is hereby corrected as shown below:

Column 10, line 16, "n" should read --no--; and
line 21, "15.." should read --150.--.

In the Claims:

Claim 1, Column 16, line 50, after "said" (first instance), the words --housing, through said at least one opening in said--should be inserted.

Claim 11, Column 20, line 15, "member" should read --members--.

Signed and Sealed this

Fourth Day of September, 1990

*Attest:*

HARRY F. MANBECK, JR.

*Attesting Officer*

*Commissioner of Patents and Trademarks*